US011480912B2

(12) United States Patent
Morimoto

(10) Patent No.: US 11,480,912 B2
(45) Date of Patent: Oct. 25, 2022

(54) IMAGE FORMING APPARATUS

(71) Applicant: KYOCERA Document Solutions Inc., Osaka (JP)

(72) Inventor: Kanako Morimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/493,172

(22) Filed: Oct. 4, 2021

(65) Prior Publication Data

US 2022/0107601 A1 Apr. 7, 2022

(30) Foreign Application Priority Data

Oct. 7, 2020 (JP) ..... JP2020-169868

(51) Int. Cl.
*G03G 15/00* (2006.01)
*G03G 21/00* (2006.01)

(52) U.S. Cl.
CPC ..... *G03G 21/0005* (2013.01); *G03G 15/50* (2013.01)

(58) Field of Classification Search
CPC ..... G03G 15/00; G03G 15/50; G03G 21/0005
USPC ..... 399/71, 343, 350
See application file for complete search history.

(56) References Cited

FOREIGN PATENT DOCUMENTS

| | | | |
|---|---|---|---|
| JP | 2007-183445 A | | 7/2007 |
| JP | 2007183445 | * | 7/2007 |
| JP | 2018194720 | * | 12/2018 |
| JP | 2019211499 | * | 12/2019 |

* cited by examiner

*Primary Examiner* — Hoan H Tran
(74) *Attorney, Agent, or Firm* — IP Business Solutions, LLC

(57) ABSTRACT

An image forming apparatus includes an image carrier, a cleaning blade, a motor, and a controller. The image carrier carries a toner image. The cleaning blade is located in contact with the image carrier. The motor drives the image carrier so as to perform reverse rotation and forward rotation. The controller measures a first torque of the image carrier during the reverse rotation, and a second torque of the image carrier during the forward rotation, on a basis of a current value of the motor. The controller calculates an amount of a substance stuck to a surface of the image carrier, on a basis of a measurement result of the first torque and the second torque.

10 Claims, 6 Drawing Sheets

IMAGE FORMING APPARATUS

INCORPORATION BY REFERENCE

This application claims priority to Japanese Patent Application No. 2020-169868 filed on Oct. 7, 2020, the entire contents of which are incorporated by reference herein.

BACKGROUND

The present disclosure relates to an image forming apparatus.

The image forming apparatus includes an intermediate transfer belt that carries a toner image, a cleaning blade located in contact with the intermediate transfer belt, to remove residual toner, an ambient temperature sensor, and a controller. With regard to such an image forming apparatus, an arrangement has been proposed that the controller predicts a failure of the cleaning blade, on the basis of a drive torque calculated from a detected current value of a motor that drives the intermediate transfer belt, and an internal temperature detected by the ambient temperature sensor.

SUMMARY

The disclosure proposes further improvement of the foregoing techniques.

In an aspect, the disclosure provides an image forming apparatus including an image carrier, a cleaning blade, a motor, and a controller. The image carrier carries a toner image. The cleaning blade is located in contact with the image carrier. The motor drives the image carrier so as to perform reverse rotation and forward rotation. The controller measures a first torque of the image carrier during the reverse rotation, and a second torque of the image carrier during the forward rotation, on a basis of a current value of the motor. The controller calculates an amount of a stuck substance on a surface of the image carrier, on a basis of a measurement result of the first torque and the second torque.

DETAILED DESCRIPTION

Figure 1:
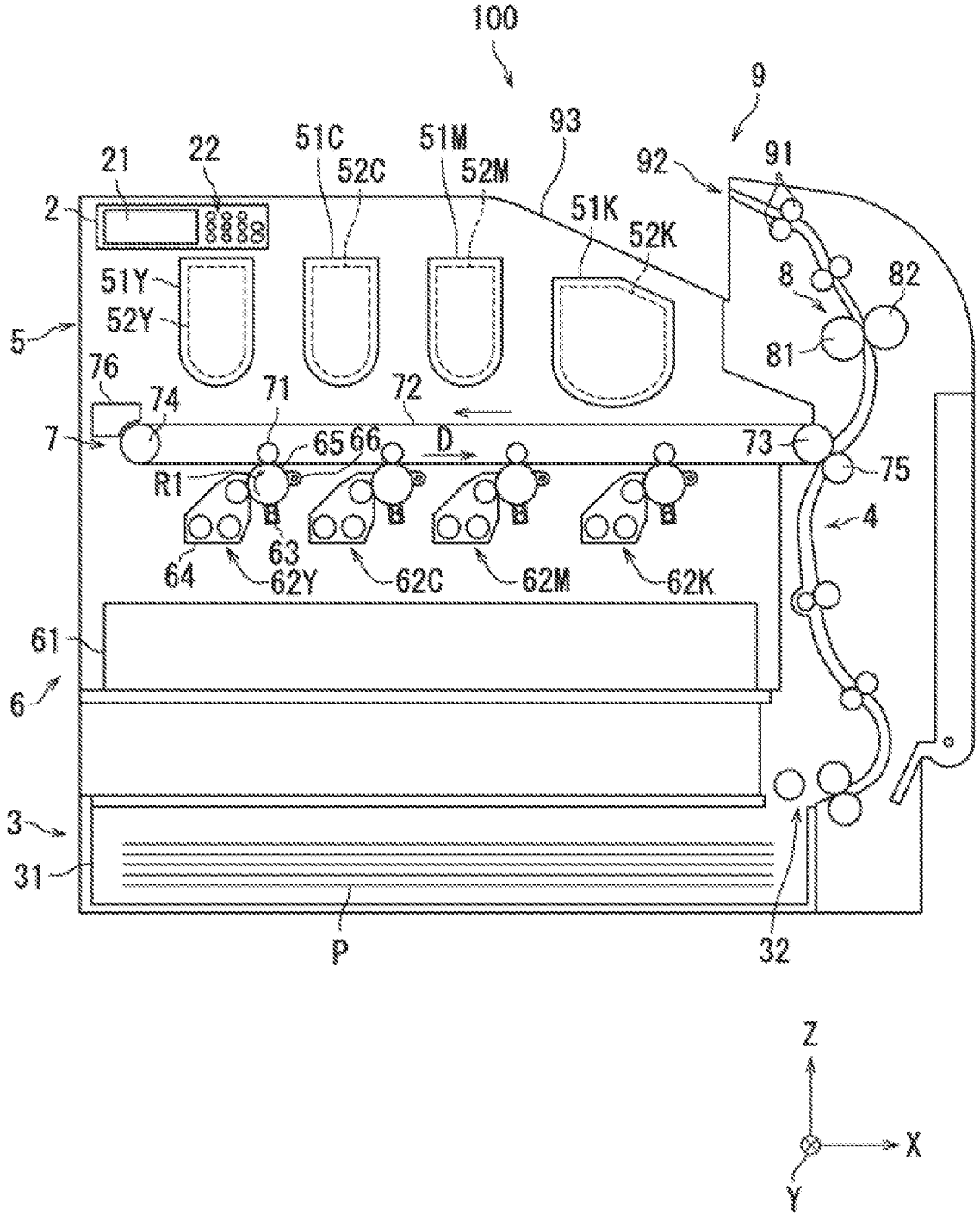
FIG. 1 is a schematic cross-sectional view showing an example of an image forming apparatus.

Hereafter, an image forming apparatus according to an embodiment of the disclosure will be described, with reference to the drawings. In the drawings, the same or corresponding elements are given the same numeral, and the description of such elements will not be repeated.

Referring to FIG. 1, the image forming apparatus 100 according to the embodiment will be described. FIG. 1 is a schematic cross-sectional view showing an example of the image forming apparatus. The image forming apparatus 100 is, for example, a color printer. For the sake of convenience in description, a left-right direction in FIG. 1 will be defined as X-direction, a depth direction will be defined as Y-direction, and an up-down direction will be defined as Z-direction.

As shown in FIG. 1, the image forming apparatus 100 includes an operation device 2, a paper feeding device 3, a transport device 4, a toner supply device 5, an image forming device 6, a transfer device 7, a fixing device 8, and a delivery area 9.

The operation device 2 receives instructions from a user. The operation device 2 includes a liquid crystal display (LCD) 21 and a plurality of operation keys 22. The LCD 21 displays, for example, various processing results. The operation keys 22 include a tenkey, a start key, and so forth.

The paper feeding device 3 includes a paper cassette 31, and a feed roller group 32. The paper cassette 31 can accommodate therein a plurality of sheets P The feed roller group 32 delivers the sheets P one by one from the paper cassette 31, to the transport device 4.

The transport device 4 includes rollers and guide members. The transport device 4 extends from the paper feeding device 3 to the delivery area 9. The transport device 4 transports the sheet P from the paper feeding device 3 to the delivery area 9, by way of the image forming device 6 and the fixing device 8.

The toner supply device 5 supplies the toner to the image forming device 6. The toner supply device 5 includes a first mounting base 51Y, a second mounting base 51C, a third mounting base 51M, and a fourth mounting base 51K.

On the first mounting base 51Y, a first toner container 52Y is mounted. Likewise, a second toner container 52C is mounted on the second mounting base 51C, a third toner container 52M is mounted on the third mounting base 51M, and a fourth toner container 52K is mounted on the fourth mounting base 51K. The first mounting base 51Y to the fourth mounting base 51K have the same configuration, except that different toner containers are mounted thereon.

In each of the first toner container 52Y, the second toner container 52C, the third toner container 52M, and the fourth toner container 52K the toner is accommodated. In this embodiment, yellow toner is accommodated in the first toner container 52Y. Cyan toner is accommodated in the second toner container 52C. Magenta toner is accommodated in the third toner container 52M. Black toner is accommodated in the fourth toner container 52K.

The image forming device 6 includes an exposure device 61, a first image forming unit 62Y, a second image forming unit 62C, a third image forming unit 62M, and a fourth image forming unit 62K.

The first image forming unit 62Y to the fourth image forming unit 62K each include a charging device 63, a developing device 64, a photoconductor drum 65, and a cleaning device 66. The photoconductor drum 65 exemplifies the "image carrier" in the disclosure. In addition, the exposure device 61, the charging device 63, and the developing device 64 exemplify the "image forming mechanism" in the disclosure.

The charging device 63, the developing device 64, and the cleaning device 66 are located along the circumferential surface of the photoconductor drum 65. In this embodiment, the photoconductor drum 65 rotates in the direction indicated by an arrow R1 in FIG. 1 (clockwise).

The charging device 63 uniformly charges, by electric discharge, the photoconductor drum 65 to a predetermined polarity. In this embodiment, the charging device 63 charges the photoconductor drum 65 to the positive polarity. The exposure device 61 emits a laser beam to the photoconductor drum 65 charged as above. As result, an electrostatic latent image is formed on the surface of the photoconductor drum 65.

The developing device 64 develops the electrostatic latent image formed on the surface of the photoconductor drum 65, thereby forming a toner image. The toner is supplied from the toner supply device 5, to the developing device 64. The developing device 64 applies the toner supplied from the toner supply device 5, to the surface of the photoconductor drum 65. As result, the toner image is formed on the surface of the photoconductor drum 65. In the developing device 64, the developing roller that supplies the toner to the surface of the photoconductor drum 65 is axially supported by an axial support mechanism on the casing of the developing device 64, so as to contact and be separated from the surface of the photoconductor drum 65, by moving toward and away therefrom. The axial support mechanism causes the developing roller to move toward and away from the photoconductor drum 65, under the control of a controller 101 (see FIG. 4).

In this embodiment, the developing device 64 in the first image forming unit 62Y is connected to the first mounting base 51Y. Accordingly, the yellow toner is supplied to the developing device 64 in the first image forming unit 62Y. On the surface of the photoconductor drum 65 of the first image forming unit 62Y, a yellow toner image is formed.

The developing device 64 in the second image forming unit 62C is connected to the second mounting base 51C. Accordingly, the cyan toner is supplied to the developing device 64 in the second image forming unit 62C. On the surface of the photoconductor drum 65 of the second image forming unit 62C, a cyan toner image is formed.

The developing device 64 in the third image forming unit 62M is connected to the third mounting base 51M. Accordingly, the magenta toner is supplied to the developing device 64 in the third image forming unit 62M. On the surface of the photoconductor drum 65 of the third image forming unit 62M, a magenta toner image is formed.

The developing device 64 in the fourth image forming unit 62K is connected to the fourth mounting base 51K. Accordingly, the black toner is supplied to the developing device 64 in the fourth image forming unit 62K. On the surface of the photoconductor drum 65 of the fourth image forming unit 62K, a black toner image is formed.

The transfer device 7 superposes the respective toner images formed on the surface of the photoconductor drum 65 of the first image forming unit 62Y to the fourth image forming unit 62K, and transfers the superposed the toner images to the sheet P. In this embodiment, the transfer device 7 transfers the superposed toner images to the sheet P, through a secondary transfer process. To be more detailed, the transfer device 7 includes four primary transfer rollers 71, an intermediate transfer belt 72, a drive roller 73, a follower roller 74, a secondary transfer roller 75, and a cleaning mechanism 76.

The intermediate transfer belt 72 is an endless belt stretched around the four primary transfer rollers 71, the drive roller 73, and the follower roller 74. The intermediate transfer belt 72 is driven by the rotation of the drive roller 73. In FIG. 1, the intermediate transfer belt 72 rotates counterclockwise. The follower roller 74 is made to rotate by the movement of the intermediate transfer belt 72.

The first image forming unit 62Y to the fourth image forming unit 62K are opposed to the lower surface of the intermediate transfer belt 72, and aligned along the moving direction D thereof. In this embodiment, the first image forming unit 62Y to the fourth image forming unit 62K are aligned in this order, from the upstream side toward the downstream side in the moving direction D of the lower surface of the intermediate transfer belt 72.

The primary transfer rollers 71 are each opposed to the photoconductor drum 65 via the intermediate transfer belt 72, and pressed against the photoconductor drum 65. Therefore, the toner image formed on the surface of each of the photoconductor drums 65 is sequentially transferred to the intermediate transfer belt 72. In this embodiment, the yellow toner image, the cyan toner image, the magenta toner image, and the black toner image are superposed and transferred in this order, onto the intermediate transfer belt 72.

The cleaning devices 66 respectively provided for the first image forming unit 62Y to the fourth image forming unit 62K serve to remove residual toner on the photoconductor drum 65, remaining after the toner image is transferred to the intermediate transfer belt 72.

The secondary transfer roller 75 is opposed to the drive roller 73, via the intermediate transfer belt 72. The secondary transfer roller 75 is pressed against the drive roller 73. Accordingly, a transfer nip is defined between the secondary transfer roller 75 and the drive roller 73. When the sheet P passes the transfer nip, the toner images superposed on the intermediate transfer belt 72 are transferred to the sheet P The sheet P having the toner images transferred thereto is transported by the transport device 4, toward the fixing device 8.

The cleaning mechanism 76 serves to remove residual toner on the intermediate transfer belt 72. The cleaning mechanism 76 is located, for example, close to the follower roller 74.

The fixing device 8 includes a heating member 81 and a pressing member 82. The heating member 81 and the pressing member 82 are opposed to each other, so as to define a fixing nip. The sheet P transported from the image forming device 6 is heated at a predetermined fixing temperature under a pressure, while passing the fixing nip. As result, the toner image is fixed to the sheet P. The sheet P is transported by the transport device 4, from the fixing device 8 to the delivery area 9.

The delivery area 9 includes a delivery roller pair 91 and an output tray 93. The delivery roller pair 91 delivers the sheet P to the output tray 93, through a delivery port 92. The delivery port 92 is located on the upper side of the image forming apparatus 100.

Figure 2:
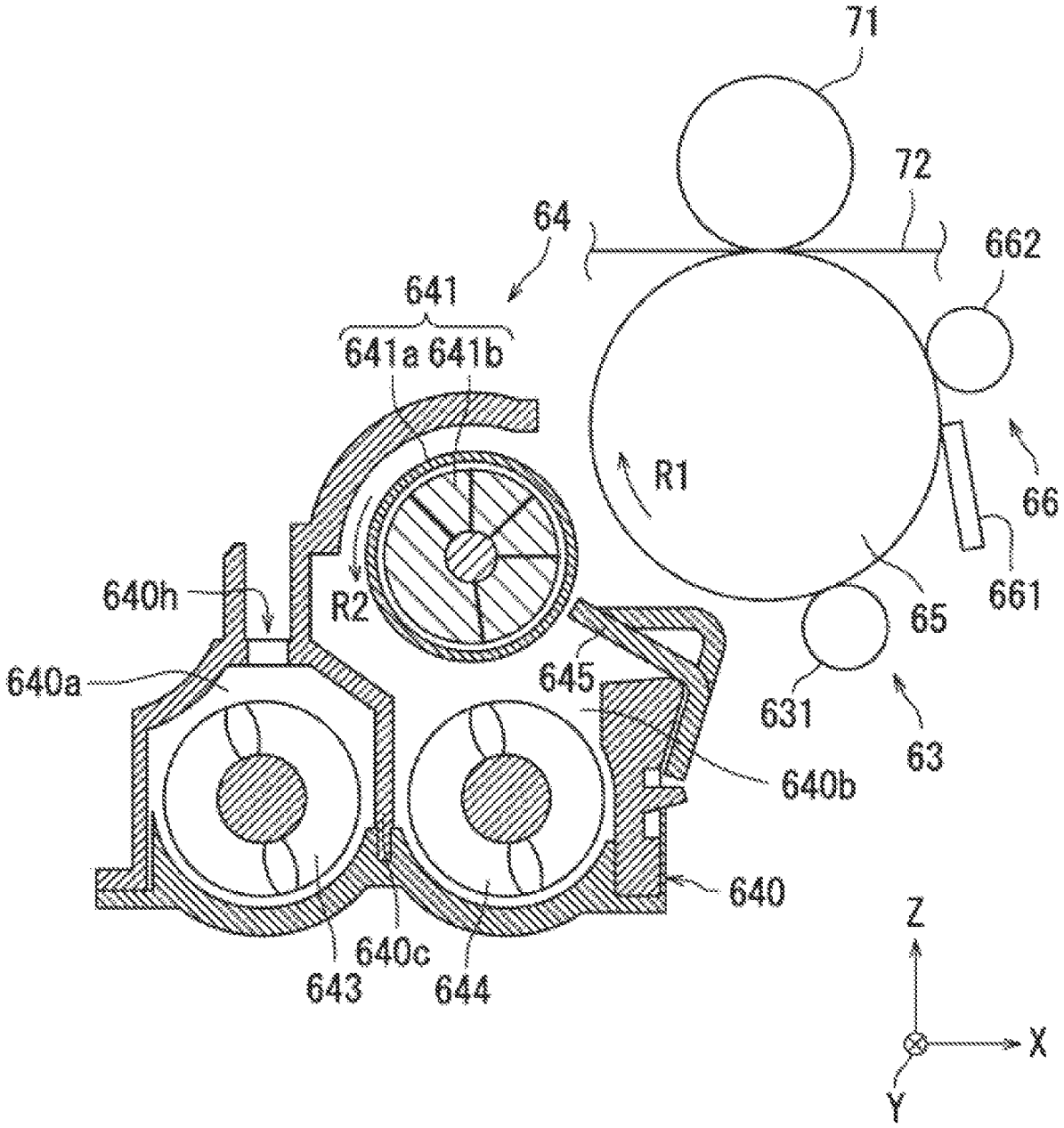
FIG. 2 is an enlarged cross-sectional view showing a detailed configuration of a photoconductor drum and peripheral parts.

Referring to FIG. 1 and FIG. 2, the configuration of the photoconductor drum 65 and the peripheral parts will be described, in further detail. FIG. 2 is an enlarged cross-sectional view showing the detailed configuration of the photoconductor drum 65 and the peripheral parts.

As shown in FIG. 2, the charging device 63 includes a charging roller 631. The charging roller 631 is located in contact with the circumferential surface of the photoconductor drum 65. To be more detailed, the charging roller 631 includes a conductive shaft, a base layer, and an outer layer. The conductive shaft is formed of a metal. The base layer includes a conductive elastic rubber, and covers the surface of the conductive shaft. The outer layer covers the surface of the base layer, and acts as a high-resistance coated layer.

The developing device 64 is located downstream of the charging device 63, in the rotation direction of the photoconductor drum 65. The developing device 64 includes a developing container 640, in which a two-component developing agent is stored. The developing device 64 includes, inside the developing container 640, a developing roller 641, a first mixing screw 643, a second mixing screw 644, and a blade 645. To be more detailed, the developing roller 641 is opposed to the second mixing screw 644. The blade 645 is opposed to the developing roller 641.

The developing container 640 is divided into a first mixing chamber 640*a* and a second mixing chamber 640*b*, by a partition wall 640*c*. The partition wall 640*c* extends in the axial direction of the developing roller 641 (Y-direction in FIG. 2). The first mixing chamber 640*a* and the second mixing chamber 640*b* communicate with each other, through an outer region of the end portions of the partition wall 640*c* in the longitudinal direction.

In the first mixing chamber 640*a*, the first mixing screw 643 is provided. In the first mixing chamber 640*a*, a magnetic carrier is stored. To the first mixing chamber 640*a*, a non-magnetic toner is supplied through a toner inlet 640*h*.

In the second mixing chamber 640*b*, the second mixing screw 644 is provided. In the second mixing chamber 640*b*, the magnetic carrier is stored.

The toner is stirred by the first mixing screw 643 and the second mixing screw 644, thus to be mixed with the carrier. As result, the two-component developing agent composed of the carrier and the toner is formed. The two-component developing agent exemplifies the "developing agent" in the disclosure.

The first mixing screw 643 and the second mixing screw 644 circulate and stir the developing agent, between the first mixing chamber 640*a* and the second mixing chamber 640*b*. As result, the toner is charged to a predetermined polarity. In this embodiment, the toner is positively charged.

The developing roller 641 includes a non-magnetic rotary sleeve 641*a* and a magnetic body 641*b*. The magnetic body 641*b* is fixed inside the rotary sleeve 641*a*. The magnetic body 641*b* includes a plurality of magnetic poles. The developing agent is adsorbed to the developing roller 641, by the magnetic force of the magnetic body 641*b*. As result, a magnetic brush is formed on the surface of the developing roller 641.

In this embodiment, the developing roller 641 rotates in the direction indicated by an arrow R2 in FIG. 2 (counterclockwise). The developing roller 641 transports, by rotating, the magnetic brush to the position opposite the blade 645. The blade 645 is located so as to define a gap between the blade 645 and the developing roller 641. Accordingly, the thickness of the magnetic brush is defined by the b blade 645. The blade 645 is located on the upstream side in the rotating direction of the developing roller 641, with respect to the position where the developing roller 641 and the photoconductor drum 65 are opposed to each other.

A predetermined voltage is applied to the developing roller 641. Accordingly, the developing agent layer formed on the surface of the developing roller 641 is transported to the position opposite the photoconductor drum 65, and the toner in the developing agent adheres to the photoconductor drum 65.

The cleaning device 66 includes a cleaning blade 661 and a rubbing roller 662. The cleaning blade 661 is located downstream of the position where the primary transfer roller 71 and the photoconductor drum 65 are opposed to each other, in the rotating direction of the photoconductor drum 65.

The cleaning blade 661 is for removing the residual toner stuck to the surface of the photoconductor drum 65. For such purpose, the edge of the cleaning blade 661 is located in contact with the surface of the photoconductor drum 65. The cleaning blade 661 is, for example, made of rubber.

The rubbing roller 662 is opposed to the photoconductor drum 65, and configured to rotate about a rotation axis. The rubbing roller 662 includes a metal shaft, and an elastic material such as foamed urethane, covering the metal shaft. For example, the rotation speed of the rubbing roller 662 is faster, or slower, than that of the photoconductor drum 65.

It is known that a discharge product sticks to the surface of the photoconductor drum 65, during the charging process thereof. The discharge product contains ionic substances such as nitrogen oxide. When the discharge product is stuck to the surface of the photoconductor drum 65, the friction coefficient of the surface of the photoconductor drum 65 is increased. When the friction coefficient of the surface of the photoconductor drum 65 is excessively increased, an excessive load is imposed on the edge of the cleaning blade 661, by which the edge of the cleaning blade 661 may suffer a local nick. Accordingly, the rubbing roller 662 serves to polish the surface of the photoconductor drum 65, thereby removing the discharge product stuck to the surface of the photoconductor drum 65. For this purpose, a part of the toner, collected by the cleaning blade 661 from the surface of the photoconductor drum 65, is supplied to the rubbing roller 662. Alternatively, the toner is supplied to the rubbing roller 662 from the developing device 64, while the printing operation is not being performed. Thus, a toner layer of a uniform thickness is formed on the surface of the rubbing roller 662. The toner contains, for example, titanium oxide that serves as a polishing agent.

In the cleaning device 66, the rubbing roller 662 is axially supported on the casing of the cleaning device 66, by an axial support mechanism so as to contact and be separated from the surface of the photoconductor drum 65, by moving toward and away therefrom. The axial support mechanism causes the rubbing roller 662 to move toward and away from the photoconductor drum 65, under the control of a controller 101 (see FIG. 4).

Figure 3:
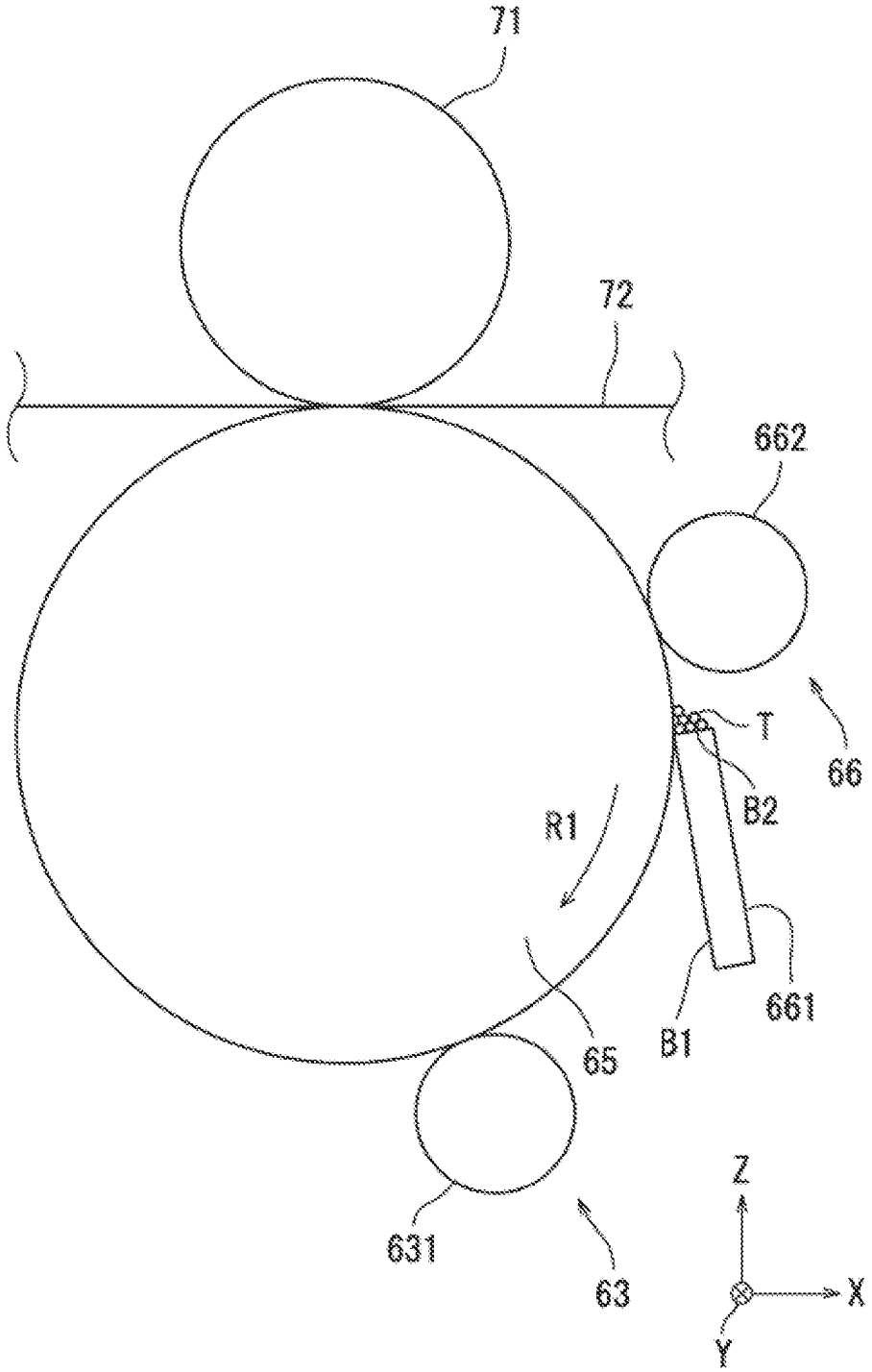
FIG. 3 is an enlarged cross-sectional view showing an example of a location of a cleaning blade.

Referring to FIG. 1 to FIG. 3, the location of the cleaning blade 661 will be described hereunder. FIG. 3 is an enlarged cross-sectional view showing an example of the location of the cleaning blade 661.

As shown in FIG. 3, the cleaning blade 661 includes a first blade surface B1 and a second blade surface B2. The first blade surface B1 is a main face of the plate-shaped cleaning blade 661. The second blade surface B2 is an end face of the cleaning blade 661. An edge is formed along the boundary between the first blade surface B1 and the second blade surface B2. The edge is located in contact with the surface of the photoconductor drum 65. When the photoconductor drum 65 rotates in the forward direction indicated by an arrow R1 in FIG. 3 (clockwise), toner particles T containing an additive is scraped up, in the space defined by the surface of the photoconductor drum 65 and the second blade surface B2. The major part of the discharge product stuck to the surface of the photoconductor drum 65 passes through under the edge of the cleaning blade 661.

Figure 4:
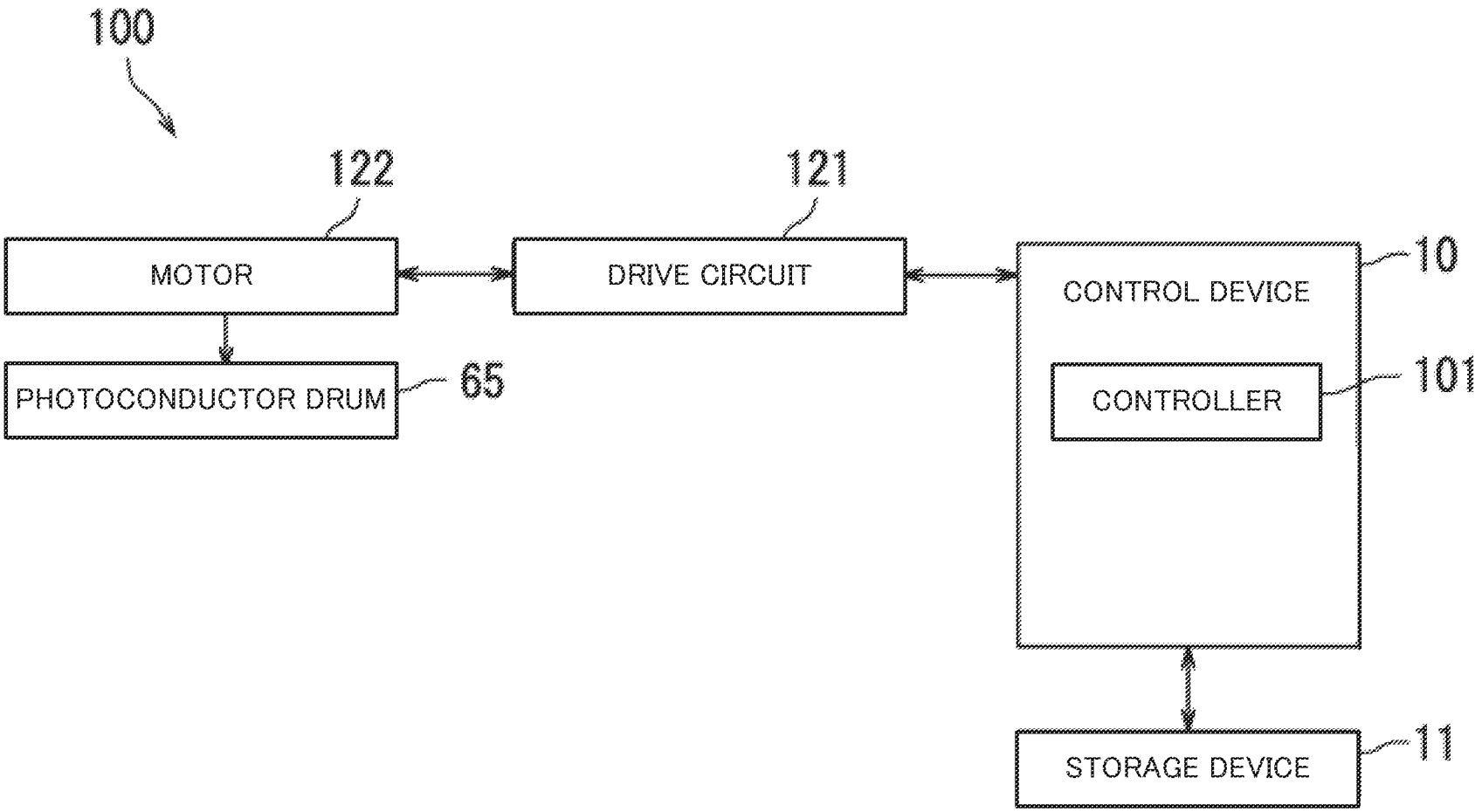
FIG. 4 is a block diagram showing an example of a circuit configuration of the image forming apparatus.

Referring now to FIG. 1 to FIG. 4, a circuit configuration of the image forming apparatus 100 will be described hereunder. FIG. 4 is a block diagram showing an example of the circuit configuration of the image forming apparatus 100.

As shown in FIG. 4, the image forming apparatus 100 includes a control device 10, a storage device 11, a drive circuit 121, and a motor 122, in addition to the photoconductor drum 65. The controller 101 of the control device 10 controls the motor 122, via the drive circuit 121. The motor 122 drives the photoconductor drum 65. The photoconductor drum 65 is made to rotate, not only in the forward direction indicated by the arrow R1 in FIG. 3 (clockwise), but also in the reverse direction (counterclockwise), through the control of the motor 122 by the controller 101.

Here, a non-illustrated rotation speed sensor is provided for the photoconductor drum 65, to detect the rotation speed thereof. The controller 101 controls the action of the motor 122, such that the rotation speed of the photoconductor drum 65 acquired from the rotation speed sensor accords with a predetermined normal operation rotation speed.

To be more detailed, when the rotation speed acquired from the rotation speed sensor is slower than the predetermined normal operation rotation speed, the controller 101 increases the drive current supplied to the motor 122, by an amount corresponding to the slowdown of the rotation speed, thereby causing the motor 122 to rotate faster, to maintain the rotation speed of the photoconductor drum 65 at the predetermined normal operation rotation speed.

In contrast, when the rotation speed acquired from the rotation speed sensor is faster than the predetermined normal operation rotation speed, the controller 101 decreases the drive current supplied to the motor 122, by an amount corresponding to the increase of the rotation speed, thereby causing the motor 122 to rotate more slowly, to maintain the rotation speed of the photoconductor drum 65 at the predetermined normal operation rotation speed.

The storage device 11 includes memory units, and contains various types of data and computer programs are stored. The storage device 11 includes a main memory unit such as a semiconductor memory, and an auxiliary memory unit such as a hard disk drive.

The control device 10 includes a processor, for example a central processing unit (CPU), and acts as a controller 101, when the processor executes the computer program stored in the storage device 11. The controller 101 controls the above-cited components of the image forming apparatus 100.

The controller 101 measures a first torque T1 during the reverse rotation of the photoconductor drum 65, and a second torque T2 during the forward rotation of the photoconductor drum 65, according to the current value of the motor 122.

The controller 101 measures the second torque T2, after measuring the first torque T1. Causing the photoconductor drum 65 to rotate in the reverse direction, before rotating in the forward direction, mitigates the impact of the toner particles T containing the additive, scraped up in the space defined by the surface of the photoconductor drum 65 and the second blade surface B2 (see FIG. 3). In other words, the increase in friction coefficient of the surface of the photoconductor drum 65, incurred by the discharge product, is accurately reflected in the difference between the first torque T1 and the second torque T2 (T1−T2). The controller 101 finishes measuring the first torque T1 before the photoconductor drum 65 makes one rotation, and proceeds to the measurement of the second torque T2.

More preferably, to improve the measurement accuracy, the controller 101 may cause the photoconductor drum 65 to rotate at a predetermined speed slower than the normal speed for the image forming operation, when measuring the first torque T1 and the second torque T2. In addition, the controller 101 may control, when measuring the first torque T1 and the second torque T2, the axial support mechanism for the developing device 64 and the axial support mechanism for the cleaning device 66 so as to cause the developing roller and the rubbing roller 662 to move away from the surface of the photoconductor drum 65, so that only the cleaning blade 661 remains in contact with the photoconductor drum 65.

The controller 101 calculates a discharge product amount Y on the surface of the photoconductor drum 65, on the basis of the measurement result of the first torque T1 and the second torque T2. More specifically, the controller 101 calculates the discharge product amount Y, on the basis of the difference between the first torque T1 and the second torque T2 (T1−T2).

When the calculated discharge product amount Y is larger than a first threshold Y1, the controller 101 activates a recovery operation for reducing the discharge product amount Y. After the recovery operation has been performed, the controller 101 again measures the first torque T1 and the second torque T2. The controller 101 again calculates the discharge product amount Y, on the basis of the second measurement result of the first torque T1 and the second torque T2. When a change rate DY of the discharge product amount Y is larger than a second threshold D1, the controller 101 presents a warning notifying the abnormality of the photoconductor drum 65, to the user through the LCD 21.

Figure 5:
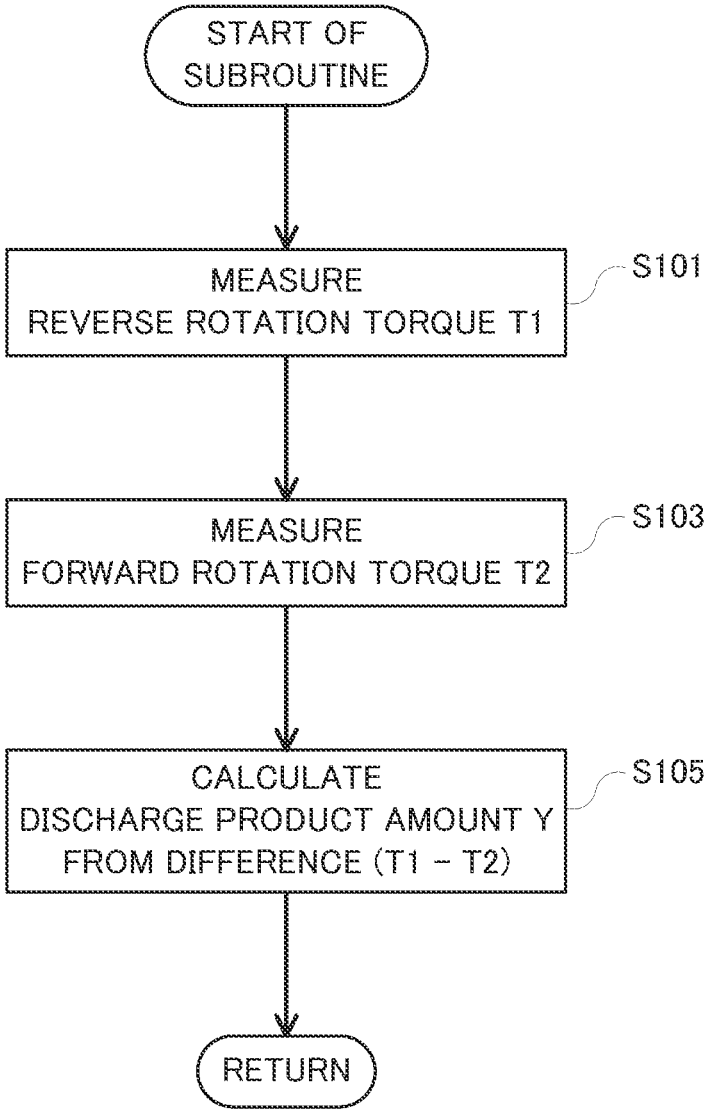
FIG. 5 is a flowchart showing an example of an operation performed by a controller.

Referring now to FIG. 1 to FIG. 5, the operation of the controller 101 will be described hereunder. FIG. 5 is a flowchart showing a measurement subroutine, which is an example of the operation performed by the controller 101.

Step S101: As shown in FIG. 5, the controller 101 measures the first torque T1, on the basis of the current value of the motor 122 (value of the drive current) at the time that the photoconductor drum 65 is made to rotate in the reverse direction. After completing the operation of step S101, the operation proceeds to step S103. In other words, it is assumed here that the first torque T1 has been obtained, on the basis of the current value of the motor 122.

Step S103: The controller 101 measures the second torque T2, on the basis of the current value of the motor 122 (value of the drive current) at the time that the photoconductor drum 65 is made to rotate in the forward direction. After completing the operation of step S103, the operation proceeds to step S105. In other words, it is assumed here that the second torque T2 has been obtained, on the basis of the current value of the motor 122.

Step S105: The controller 101 calculates the discharge product amount Y, on the basis of the difference between the first torque T1 and the second torque T2 (T1−T2). When the operation of step S105 is completed, the measurement subroutine is finished.

It is assumed that a known and standard photoconductor drum is used, and an amount of a discharge product adhering to the surface of the photoconductor drum is measured and clarified by an analytical means such as AFM (Atomic Force Microscope). By measuring a first torque t1 (a reverse rotation torque) and a second torque t2 (a forward rotation torque) of the known and standard photosensitive drum, it is possible to create a calibration curve. A difference between the first torque t1 and the second torque t2 of the known and standard photosensitive drum is calculated. Further, the difference a corrected using the constant p is calculated as a following equation (1).

$$a=p(t1-t2) \tag{1}$$

The constant p is determined according to the rubber condition of the cleaning blade 661, and environmental conditions.

On the other hand, with respect to the photosensitive drum 65, the control unit 101 calculates the difference between the first torque T1 measured in step S101 and the second torque T2 measured in step S103. Further, the control unit 101 corrects the difference using constant p and calculates the difference A using the following equation (2).

$$A=p(T1-T2) \quad (2)$$

The controller 101 calculates the discharge product amount Y of the photosensitive drum 65 with the following equations (3) and (4), using a variable X, a first corrected constant q, and a second corrected constant r (S105).

$$X=T1+(a-A) \quad (3)$$

$$Y=qX+r \quad (4)$$

For calculating the amount of the discharge product, it is necessary to eliminate the influence of deposits (toner and external additives, etc.) on the surface of the photosensitive drum 65 and changes in the surface of the drum due to wear of the blade 661 on the torque. Therefore, in the present disclosure, the difference between the difference a and the difference A is used as a value to be added to the first torque T1 when the photosensitive drum 65 is rotated in the reverse rotation, and the first torque T1 (X) after the addition is provisionally used as the amount of the discharge product. Then, the value obtained by correcting the first torque T1 (X) using the correction constants q and r is calculated as the amount Y of the discharge product on the surface of the photosensitive drum 65.

Thus, in this embodiment, the value obtained by further correcting the current value obtained by adding the difference between the difference a and the difference A to the current value indicating the first torque of the photosensitive drum 65 is estimated and calculated as the discharge product amount Y of the photosensitive drum 65.

Figure 6:
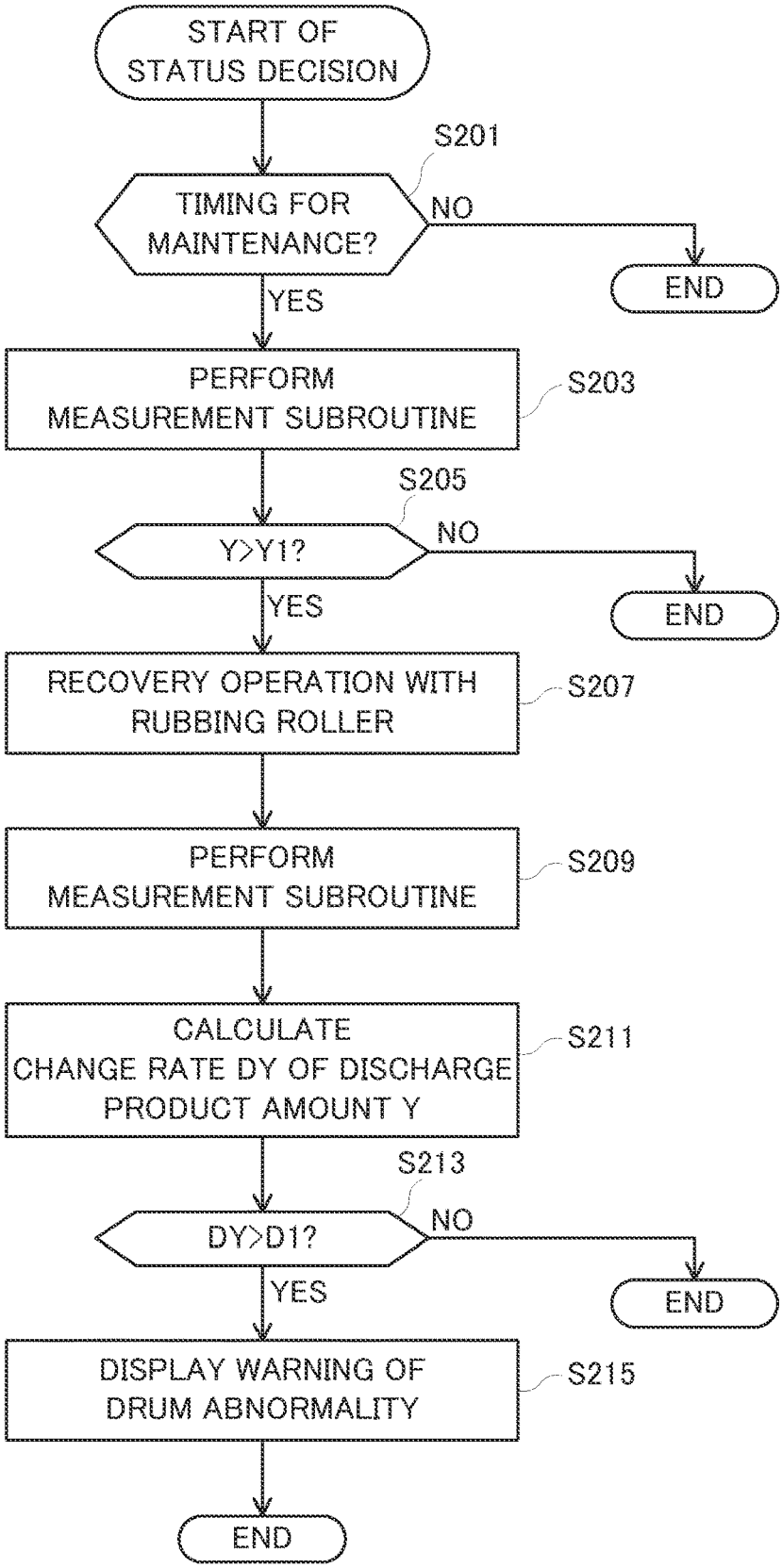
FIG. 6 is a flowchart showing another example of the operation performed by the controller.

Referring to FIG. 1 to FIG. 6, the operation of the controller 101 will be described further. FIG. 6 is a flowchart showing a status decision process, which is another example of the operation performed by the controller 101.

Step S201: As shown in FIG. 6, the controller 101 decides whether a timing for periodical maintenance has been reached. When the controller 101 decides that it is the time for the maintenance (Yes at step S201), the operation proceeds to step S203. When the controller 101 decides that it is not the time for the maintenance (No at step S201), the status decision process is finished.

Step S203: The controller 101 performs the measurement subroutine, thereby acquiring the calculated value of the discharge product amount Y. When the controller 101 completes the operation of step S203, the operation of the controller 101 proceeds to step S205.

Step S205: The controller 101 decides whether the calculated value of the discharge product amount Y acquired at step S203 is larger than the first threshold Y1. When the controller 101 decides that the calculated value of the discharge product amount Y is larger than the first threshold Y1 (Yes at step S205), the operation of the controller 101 proceeds to step S207. When the controller 101 decides that the calculated value of the discharge product amount Y is not larger than the first threshold Y1 (No at step S205), the controller 101 finishes the status decision process.

Step S207: The controller 101 causes the rubbing roller 662 to perform the recovery operation including polishing the surface of the photoconductor drum 65. As result, the discharge product amount Y on the surface of the photoconductor drum 65 is reduced, and the status of the surface of the photoconductor drum 65 becomes similar to an initial status. When the controller 101 completes the operation of step S207, the operation of the controller 101 proceeds to step S209.

Step S209: The controller 101 again performs the measurement subroutine. As result, the controller 101 acquires the calculated value based on the reduced discharge product amount Y. When the controller 101 completes the operation of step S209, the operation proceeds to step S211.

Step S211: The controller 101 calculates the change rate DY per unit time, of the discharge product amount Y. When the controller 101 completes the operation of step S211, the operation proceeds to step S213.

Step S213: The controller 101 decides whether the change rate DY calculated at step S211 is larger than the second threshold D1. When the controller 101 decides that the change rate DY is larger than the second threshold D1 (Yes at step S213), The operation proceeds to step S215. When the controller 101 decides that the change rate DY is not larger than the second threshold D1 (No at step S213), the status decision process is finished.

Step S215: The controller 101 causes the LCD 21 to display a warning notifying the abnormality of the photoconductor drum 65. Thus, the warning notifying the abnormality of the photoconductor drum 65 is presented to the user. When the operation of step S215 is completed, the status decision process is finished.

The status decision process shown in FIG. 6 includes the recovery (polishing) operation for the photoconductor drum 65 to be performed when necessary, and therefore the deterioration of the cleaning blade 661 can be prevented.

Thus, according to the foregoing embodiment, the image forming apparatus 100, capable of accurately calculating the discharge product amount Y stuck to the surface of the photoconductor drum 65, can be obtained.

Here, in the case of an image forming apparatus configured to predict the failure of the cleaning blade, on the basis of only the drive torque in the normal rotation (forward rotation) of the intermediate transfer belt, it is difficult to accurately detect the amount of the stuck substance on the surface of the intermediate transfer belt, which is unable to be completely removed by the cleaning blade. Accordingly, such a technique is also unable to accurately detect the discharge product amount on the surface of the photoconductor drum. With the configuration according to the foregoing embodiment, in contrast, the amount of the stuck substance on the surface of the photoconductor drum can be accurately calculated, as described above.

The embodiment of the disclosure has been described as above, with reference to the drawings. However, the disclosure is not limited to the foregoing embodiment, but may be implemented in various manners without departing from the scope of the disclosure. The plurality of constituent elements disclosed in the foregoing embodiment may be combined as desired, to achieve various inventions. For example, some constituent elements may be excluded, from those disclosed in the foregoing embodiment. The drawings each schematically illustrate the essential constituent elements for the sake of clarity, and the thickness, the length, and the number of pieces of each of the illustrated constituent elements may differ from the actual ones, depending on the convenience in making up the drawings. Further, the material, the shape, and the dimensions of the constituent elements described in the foregoing embodiment are merely exemplary, and may be modified in various manners without substantially departing from the effects expected from the present invention.

Although the image forming apparatus 100 is exemplified by the color printer in the foregoing embodiment, the disclosure is not limited thereto. The image forming apparatus 100 may be any apparatus that forms an image using the electrophotography technique.

Although the two-component developing agent is employed as the developing agent in the foregoing embodiment, the disclosure is not limited thereto. The developing agent may be a one-component developing agent.

Further, although the image carrier is exemplified by the photoconductor drum 65 in the foregoing embodiment, the disclosure is not limited thereto. The image carrier may be the intermediate transfer belt 72. In this case, the cleaning mechanism 76 includes a cleaning blade to be made to contact the intermediate transfer belt 72. The controller 101 measures the first torque during the reverse rotation of the intermediate transfer belt 72, and the second torque during the forward rotation of the intermediate transfer belt 72. Then the controller 101 calculates the amount of the stuck substance on the surface of the intermediate transfer belt 72, on the basis of the measurement result of the first torque and the second torque.

Further, although the discharge product amount Y is calculated according to the equations (1) to (4) in the foregoing embodiment, other equations may be employed instead. The discharge product amount Y may be expressed as an absolute value (e.g., $mg/cm^2$), or a relative sticking rate per unit area.

INDUSTRIAL APPLICABILITY

The disclosure is applicable to the technical field of the image forming apparatus.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

an image carrier that carries a toner image;

a cleaning blade located in contact with the image carrier;

a motor that drives the image carrier so as to perform reverse rotation and forward rotation; and a controller that measures a first torque of the image carrier during the reverse rotation, and a second torque of the image carrier during the forward rotation, on a basis of a current value of the motor, wherein the controller calculates an amount of a stuck substance on a surface of the image carrier, on a basis of a measurement result of the first torque and the second torque.

2. The image forming apparatus according to claim 1, wherein the controller calculates the amount of the stuck substance, on a basis of a difference between the first torque and the second torque.

3. The image forming apparatus according to claim 2, wherein the controller calculates a value corrected with a coefficient from a value obtained by adding the difference to the first torque, as a value indicating the amount of the stuck substance.

4. The image forming apparatus according to claim 1, wherein the controller measures the second torque, after measuring the first torque.

5. The image forming apparatus according to claim 4, wherein the controller finishes measuring the first torque, before the image carrier makes one rotation.

6. The image forming apparatus according to claim 1, wherein, when measuring the first torque and the second torque, the controller causes the image carrier to rotate at a predetermined speed slower than a normal speed for image forming operation.

7. The image forming apparatus according to claim 1, further comprising an image forming mechanism that forms the toner image on a circumferential surface of the image carrier, and a cleaning device for the image carrier, the image forming mechanism and the cleaning device being located around the image carrier, wherein the controller performs, when measuring the first torque and the second torque, an operation control including causing a developing device of the image forming mechanism and the cleaning device to move away from the circumferential surface of the image carrier, and allowing only the cleaning blade to contact the image carrier.

8. The image forming apparatus according to claim 1, wherein the image carrier includes a photoconductor drum, and the stuck substance includes a discharge product.

9. The image forming apparatus according to claim 8, further comprising a rubbing roller configured to rotate, with a circumferential surface opposed to the image carrier, wherein the controller causes the rubbing roller to perform a recovery operation for reducing the discharge product amount, when the calculated discharge product amount is larger than a first threshold.

10. The image forming apparatus according to claim 9, further comprising a display device, wherein the controller again measures the first torque and the second torque after the recovery operation is performed, and the controller again calculates the discharge product amount on a basis of a result of the measurement of the first torque and the second torque that has been again performed, and causes the display device to display a warning notifying abnormality of the photoconductor drum, when a change rate of the discharge product amount is larger than a second threshold.

* * * * *